US007703768B2

(12) United States Patent
Tamura et al.

(10) Patent No.: US 7,703,768 B2
(45) Date of Patent: Apr. 27, 2010

(54) IMAGE FORMING SYSTEM, RELAY CONVEYANCE APPARATUS AND METHOD FOR INSTALLING IMAGE FORMING SYSTEM

(75) Inventors: Hitoshi Tamura, Hachioji (JP); Masaaki Uchiyama, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 351 days.

(21) Appl. No.: 11/653,730

(22) Filed: Jan. 16, 2007

(65) Prior Publication Data

US 2008/0018040 A1 Jan. 24, 2008

(30) Foreign Application Priority Data

Jul. 21, 2006 (JP) ..... 2006-199176

(51) Int. Cl.
*B65H 5/00* (2006.01)

(52) U.S. Cl. ..... 271/264; 399/110; 399/126

(58) Field of Classification Search ..... 271/279, 271/292, 264; 270/58.01; 399/110, 124, 399/126, 407

See application file for complete search history.

(56) References Cited

U.S. PATENT DOCUMENTS 6,308,026 B1 * 10/2001 Kouchi ..... 399/110
6,311,032 B1 * 10/2001 Carter et al. ..... 399/107
7,261,288 B2 * 8/2007 Hosoya et al. ..... 270/58.07
7,426,367 B2 * 9/2008 Hirai ..... 399/407
7,505,707 B2 * 3/2009 Makino ..... 399/107
7,529,499 B2 * 5/2009 Makino ..... 399/107
7,551,875 B2 * 6/2009 Amarakoon ..... 399/110
2002/0163118 A1 * 11/2002 Inoue ..... 271/162
2004/0047652 A1 * 3/2004 Ohgita et al. ..... 399/124
2005/0084308 A1 * 4/2005 Nakamura et al. ..... 399/407
2006/0018695 A1 * 1/2006 Hirai ..... 399/407
2006/0120783 A1 * 6/2006 Tokita et al. ..... 399/407

(Continued)

FOREIGN PATENT DOCUMENTS

JP 06278927 10/1994

(Continued)

OTHER PUBLICATIONS

Japanese Office Action for Application No. 2006-199176; Date mailed May 20, 2008; with English translation.

*Primary Examiner*—Patrick H Mackey
*Assistant Examiner*—Jeremy Severson
(74) *Attorney, Agent, or Firm*—Cantor Colburn LLP

(57) ABSTRACT

There is described an image forming system that includes an image forming apparatus provided with a first paper sheet outlet to eject the paper sheet outside therefrom; a post processing apparatus that is provided with a second paper sheet inlet; and a relay conveyance apparatus that is installed between the image forming apparatus and the post processing apparatus. The relay conveyance apparatus includes a relay conveyance unit, disposed at an upper space of the relay conveyance apparatus and provided with a first paper sheet inlet and a second paper sheet outlet and a coupling unit, which fixes the image forming apparatus and the post processing apparatus to the relay conveyance apparatus, in such a manner that the first paper sheet outlet and the second paper sheet outlet substantially coincide with the first paper sheet inlet and the second paper sheet inlet, respectively.

14 Claims, 5 Drawing Sheets

U.S. PATENT DOCUMENTS

| | | | | |
|---|---|---|---|---|
| 2007/0098470 | A1* | 5/2007 | Shida et al. | 399/341 |
| 2008/0298867 | A1* | 12/2008 | Watanabe et al. | 399/407 |
| 2009/0062096 | A1* | 3/2009 | Sasahara | 493/396 |

FOREIGN PATENT DOCUMENTS

| | | |
|---|---|---|
| JP | 2002278194 | 9/2002 |
| JP | 2004101605 | 4/2004 |
| JP | 2004-161466 | 6/2004 |
| JP | 2004161466 | 6/2004 |
| JP | 2004205949 | 7/2004 |
| JP | 2005-254362 | 9/2005 |

* cited by examiner

IMAGE FORMING SYSTEM, RELAY CONVEYANCE APPARATUS AND METHOD FOR INSTALLING IMAGE FORMING SYSTEM

This application is based on Japanese Patent Application NO. 2006-199176 filed on Jul. 21, 2006 in Japanese Patent Office, the entire content of which is hereby incorporated by reference.

BACKGROUND OF THE INVENTION

The present invention relates to an image forming system that is constituted by an image forming apparatus and a plurality of paper sheet processing apparatuses, which are coupled to each other in the system.

Various kinds of peripheral apparatuses are optionally coupled to the image forming apparatus, such as an electrophotographic image forming apparatus, so as to form a versatile image forming system.

This kind of image forming system is utilized not only as a utility in an office or a copy center, but also in the field of the POD (Print On Demand).

Conventionally, a single post processing apparatus, in which various kinds of processors, such as a stapler, a puncher, etc., are integrated, is generally combined with the image forming apparatus as the peripheral apparatus of the image forming apparatus employing the electro-photographic imaging method.

According as the functional demands for the peripheral apparatus have been diversified, however, it becomes difficult to integrate various kinds of functional structures into a single apparatus. As a result, a trend for forming and using the image forming system in which a plurality of peripheral apparatuses are concatenated with each other has emerged recently.

For instance, Patent Document 1 (Tokkai 2004-161466, Japanese Non-Examined Patent Publication) sets forth an image forming system in which a post processing apparatus having a folding function is coupled to the image forming apparatus, and further another post processing apparatus having an end stitching (plane stitching), a center folding and a saddle stitching functions is coupled.

Further, Patent Document 2 (Tokkai 2005-254362, Japanese Non-Examined Patent Publication) sets forth an image forming system in which an interface module is installed between the image forming apparatus and an post processing apparatus having a punching and a saddle stitching functions, so that the interface module can supply an additional paper sheet, other than the paper sheets conveyed from the image forming apparatus.

As described in Patent Documents 1 and 2 (Tokkai 2004-161466 and Tokkai 2005-254362 Japanese Non-Examined Patent Publication), in the configuration in which a plurality of post processing apparatuses are concatenated to the image forming apparatus, the conveyance path in the paper sheet processing apparatus to be disposed at an intermediate position (hereinafter, referred to as an relay conveyance apparatus) is designed to be as shorter as possible, in order to suppress the occurrence probability of the apparatus stopping accident due to the conveyance malfunction as a whole by reducing the conveyance malfunction in the relay conveyance apparatus, in order to improve the efficiency of the apparatus as a whole by increasing the processing velocity in the image forming mode in which the relay conveyance apparatus is deactivated, etc. In addition, even if the relay conveyance apparatus is designed to conduct a kind of paper sheet processing, a relatively simple processing structure is installed into the relay conveyance apparatus.

According to the reasons mentioned in the above, the relay conveyance apparatus tends to be designed in such a manner that the horizontal width of the relay conveyance apparatus is as shorter as possible when viewing it from the front of the image forming system.

In Patent Documents 1 and 2 (Tokkai 2004-161466 and Tokkai 2005-254362 Japanese Non-Examined Patent Publication), the post processing apparatus PZ and the interface module 4, both serving as the relay conveyance apparatus, are also designed in such a manner that the horizontal width of each of them is shorter than that of the image forming apparatus or the other post processing apparatus to be disposed at the both sides of them.

SUMMARY OF THE INVENTION

According to an aspect of the present invention, the image forming system comprises: a plurality of paper sheet processing apparatuses including an image forming apparatus that forms an image on a paper sheet and a relay conveyance apparatus that is installed between a former paper-sheet processing apparatus and a latter paper-sheet processing apparatus, both included in the plurality of paper sheet processing apparatuses, so as to relay the paper sheet from the former paper-sheet processing apparatus to the latter paper-sheet processing apparatus; wherein the relay conveyance apparatus includes: a relay conveyance unit, disposed at an upper space of the relay conveyance apparatus and provided with a paper sheet inlet and a paper sheet outlet, to convey the paper sheet introduced from the paper sheet inlet therein and eject the paper sheet outside from the paper sheet outlet; and a coupling unit, disposed at a lower space of the relay conveyance apparatus, to establish an intermediate space into which the relay conveyance unit can be mounted; wherein the coupling unit is provided with fixing members for securely fixing the former paper-sheet processing apparatus and the latter paper-sheet processing apparatus to the relay conveyance apparatus, in such a manner that the paper sheet inlet and the paper sheet outlet substantially coincide with a paper sheet outlet of the former paper-sheet processing apparatus and a paper sheet inlet of the latter paper-sheet processing apparatus, respectively.

According to another aspect of the present invention, in the relay conveyance apparatus that is installed in an intermediate space formed between any pair of a former paper-sheet processing apparatus and a latter paper-sheet processing apparatus, both included in a plurality of paper sheet processing apparatuses, the relay conveyance apparatus comprises: a coupling unit to fix the former paper-sheet processing apparatus and the latter paper-sheet processing apparatus to the relay conveyance unit in a predetermined positional relationship between them, so as to form the intermediate space; and a relay conveyance unit to be mounted in the intermediate space and provided with a paper sheet conveying member which conveys the paper sheet from the former paper sheet processing apparatus to the latter paper sheet processing apparatus.

According to still another aspect of the present invention, the method for installing a plurality of paper-sheet processing apparatuses including an image forming apparatus in an image forming system, comprises: connecting two paper-sheet processing apparatuses to each other by employing a coupling apparatuses to be installed between the two paper-sheet processing apparatuses; fixing a positional relationship of a former paper-sheet processing apparatus and a latter paper-sheet processing apparatus in a upper-to-lower direction, a right-to-left direction and a front-to-rear direction; installing a relay conveyance unit in an intermediate space formed between the former paper-sheet processing apparatus and the latter paper-sheet processing apparatus; adjusting positions of paper sheet inlets and outlets, which are provided in the former paper-sheet processing apparatus and the latter paper-sheet processing apparatus, to those of the relay conveyance unit, so that a paper sheet outlet of the former paper-sheet processing apparatus and a paper sheet outlet of the relay conveyance unit substantially coincide with a paper sheet inlet of the relay conveyance and a paper sheet inlet of the latter paper-sheet processing apparatus, respectively.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENT

Figure 1:
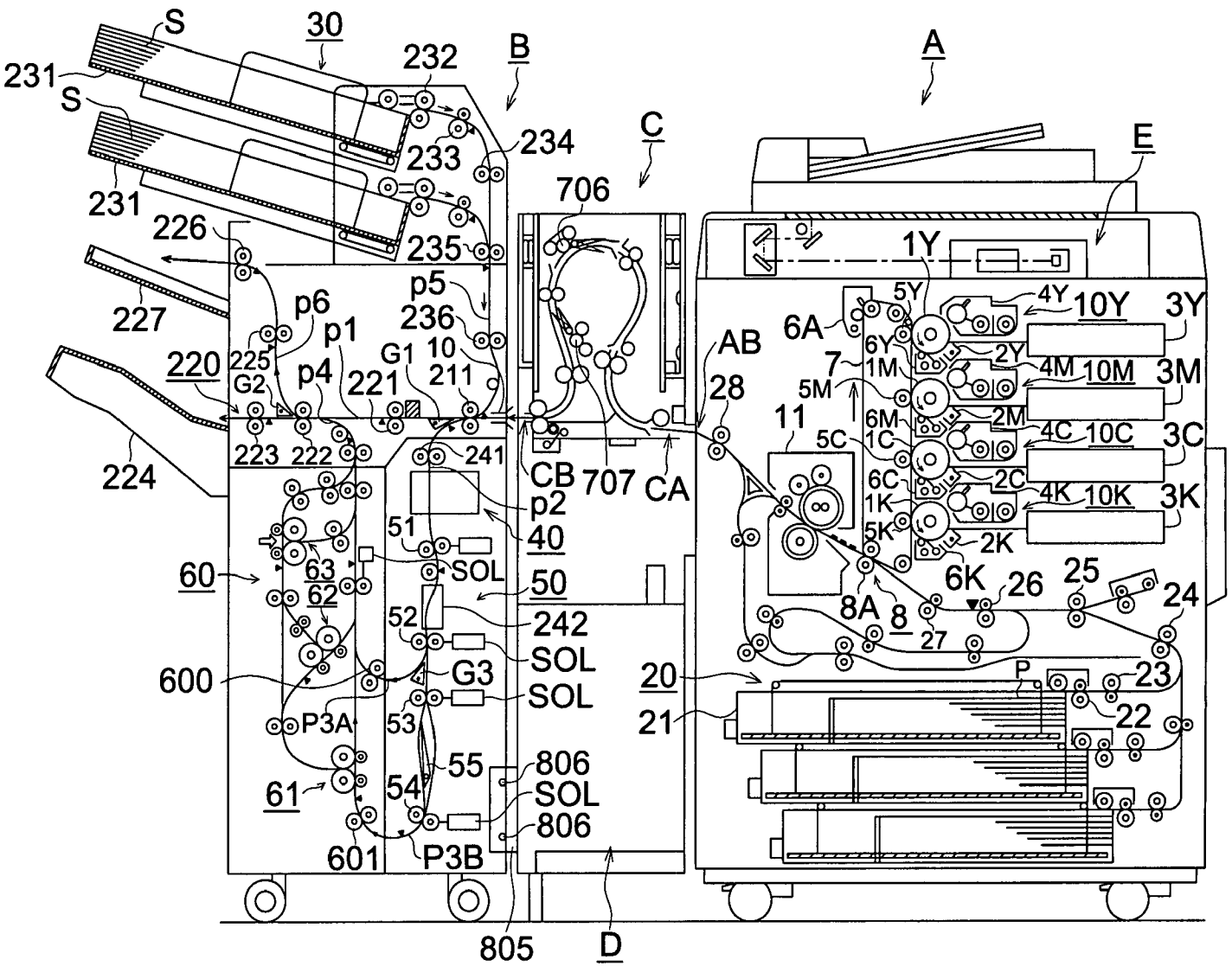
FIG. 1 shows a cross sectional view of an overall configuration of an image forming system embodied in the present invention.

Referring to the drawings, the embodiment of the present invention will be detailed in the following. However, the scope of the present invention is not limited to the embodiment described in the following.

FIG. 1 shows a cross sectional view of an overall configuration of the image forming system embodied in the present invention. The image forming system includes an color image forming apparatus A, serving as a paper sheet processing apparatus capable of forming a color image, a post processing apparatus B, serving as another paper sheet processing apparatus capable of conducting a punch processing and a fold processing and a relay conveyance apparatus.

The color image forming apparatus A is called a tandem-type color image forming apparatus and includes a plurality of image forming sections 10Y, 10M, 10C, 10K, a belt-type intermediate transfer member 7, primary transfer sections 5Y, 5M, 5C, 5K, an intermediate transfer unit including a secondary transfer section 8, a fixing device 11 and a paper sheet feeding section 20.

The color image forming apparatus A is provided with an image reading apparatus E disposed at upper side of the color image forming apparatus A.

The image forming section 10Y for forming a toner image of color Y (Yellow) includes an image bearing member 1Y, a charging device 2Y, an exposing device 3Y, a developing device 4Y and a cleaning device 6Y, all of which are disposed at respective positions in the peripheral space around the circumferential surface of the image bearing member 1Y.

The image forming section 10M for forming a toner image of color M (Magenta) includes an image bearing member 1M, a charging device 2M, an exposing device 3M, a developing device 4M and a cleaning device 6M, all of which are disposed at respective positions in the peripheral space around the circumferential surface of the image bearing member 1M.

The image forming section 10C for forming a toner image of color C (Cyan) includes an image bearing member 1C, a charging device 2C, an exposing device 3C, a developing device 4C and a cleaning device 6C, all of which are disposed at respective positions in the peripheral space around the circumferential surface of the image bearing member 1C.

The image forming section 10K for forming a toner image of color K (Black) includes an image bearing member 1K, a charging device 2K, an exposing device 3K, a developing device 4K and a cleaning device 6K, all of which are disposed at respective positions in the peripheral space around the circumferential surface of an image bearing member 1K.

Each of combinations of the charging device 2Y and the exposing device 3Y, the charging device 2M and the exposing device 3M, the charging device 2C and the exposing device 3C, and the charging device 2K and the exposing device 3K, constitutes a latent image forming section.

A well-known material, such as an OPC photoreceptor member, an aSi (amorphous Silicon) photoreceptor member, etc., can be employed for the image bearing members 1Y, 1M, 1C, 1K. Among such the well-known materials, the OPC photoreceptor member is preferable, and the OPC photoreceptor member having a negative charging property is specifically preferable, which is employed in this embodiment.

A corona discharger, such as a scorotron discharger, a corotron discharger, etc., is employed as each of the charging devices 2Y, 2M, 2C, 2K. Among them, the scorotron discharger is preferably employed.

A light emitting element, such as a laser, a LED (light emitting diode) array, etc., which emits light modulated in accordance with the image data, is employed as each of the exposing devices 3Y, 3M, 3C, 3K.

The belt-type intermediate transfer member 7 has a semiconductive property and is threaded on the plurality of supporting rollers 71, 72, 73, 74 and a backup roller 75, so as to make it possible to circulate around them. In the present embodiment, the belt-type intermediate transfer member 7 is supported in a state of flat plane in the section between the supporting rollers 73 and 74.

The unicolor toner images of colors Y, M, C, K formed by the image forming sections 10Y, 10M, 10C, 10K are sequentially transferred one by one onto the belt-type intermediate transfer member 7 by the primary transfer sections 5Y, 5M, 5C, 5K, (primary transferring operation), so as to form a full color toner image superimposed on the belt-type intermediate transfer member 7.

A paper sheet P accommodated in a paper sheet feeding cassette 21 of the paper sheet feeding section 20 is picked up by a pickup roller 22 (a first paper sheet feeding section) and is conveyed to the secondary transfer section 8 through pairs of paper sheet feeding rollers 23, 24, 25, a pair of registration rollers 26 (a second paper sheet feeding section) and a pair of conveyance rollers 27, in order to transfer the full color toner image onto the paper sheet P (secondary transferring operation).

Successively, a fixing device 11 applies heat and pressure onto the paper sheet P onto which the full color toner image is transferred, so as to fix a color toner image or a unicolor toner image onto the paper sheet P. The paper sheet P, for which the fixing operation is completed, is ejected from a paper sheet outlet AB by a pair of ejecting rollers 28 and is conveyed into a relay conveyance unit C.

On the other hand, after the full color toner image is transferred onto the paper sheet P by the secondary transfer section 8, and the paper sheet P is separated from the belt-type intermediate transfer member 7 by the curvature separating action, the residual toner remaining on the belt-type intermediate transfer member 7 are removed therefrom by a cleaning section 6A.

The relay conveyance apparatus is provided with the relay conveyance unit C and an electric power supplying unit D.

In the present embodiment, the relay conveyance unit C includes curl rectifying mechanisms, which serve as a paper sheet processing section for rectifying a curl deficiency of the paper sheet P.

Figure 2:
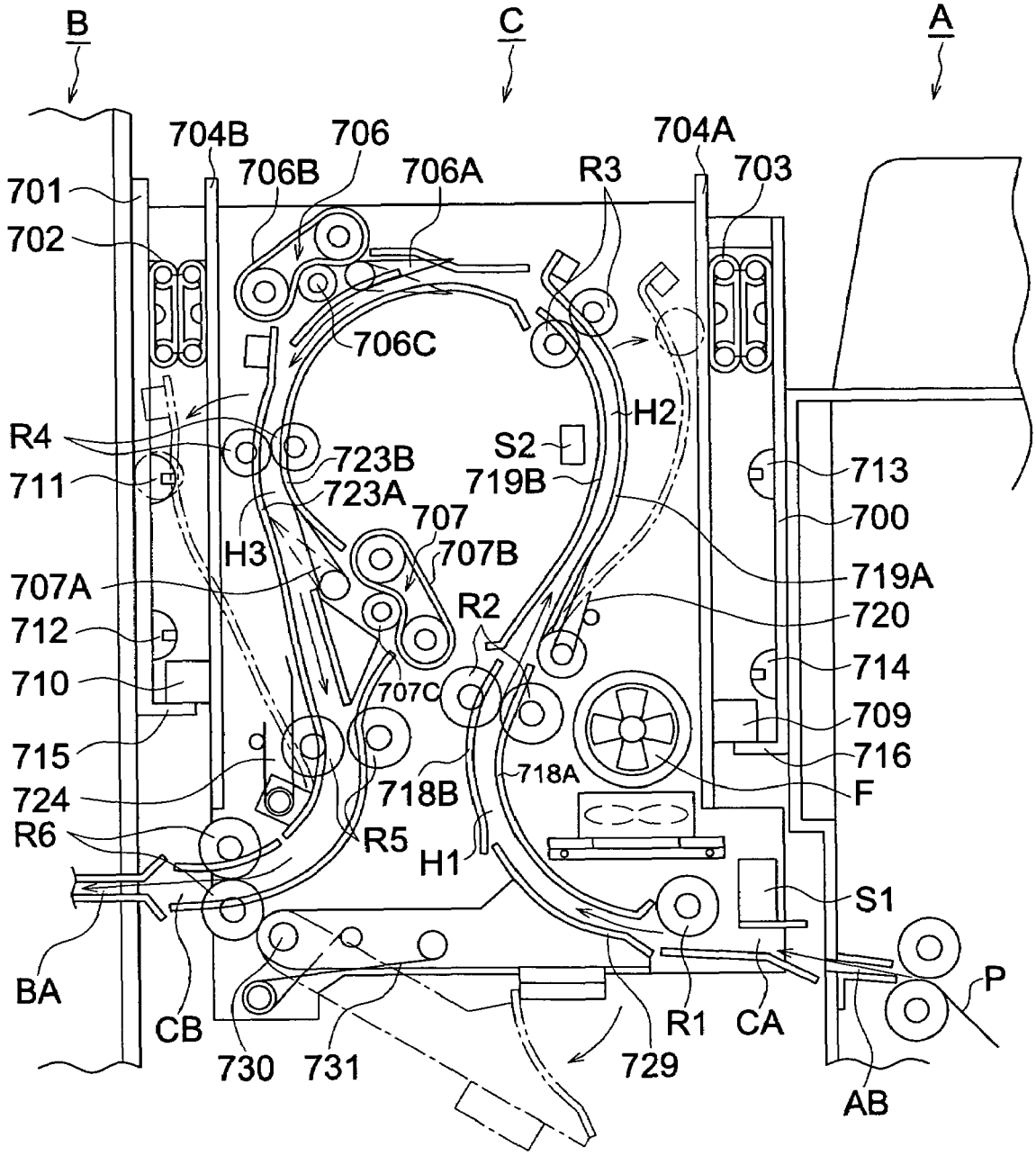
FIG. 2 shows a cross sectional front view of a relay conveyance unit.

Referring to FIG. 2, the curl rectifying actions performed in the relay conveyance unit C will be detailed in the following. FIG. 2 shows a cross sectional front view of the relay conveyance unit C.

Numeral 706 indicates a curl rectifying mechanism for rectifying such a curl that the center portion of the paper sheet P is shaped in a concave line (hereinafter, referred to as a concave curl). The curl rectifying mechanism 706 is constituted by a belt unit 706B, including a pair of rollers and a belt threaded on the pair of rollers, and a pressure roller 706C. The pressure roller 706C, urged by a spring (not shown in the drawings), press-pushes the belt so as to form a curved paper sheet path in the section between the belt unit 706B and the pressure roller 706C. The paper sheet P passes through the curved paper sheet path formed by the pressure roller 706C, so that the concave curl of the paper sheet P is rectified by applying a bending force, the direction of which is opposite to the concave curl, to the paper sheet P.

Numeral 707 indicates a curl rectifying mechanism for rectifying such a curl that the center portion of the paper sheet P is shaped in a convex line (hereinafter, referred to as a convex curl). The curl rectifying mechanism 707 is constituted by a belt unit 707B, including a pair of rollers and a belt threaded on the pair of rollers, and a pressure roller 707C. The pressure roller 707C, urged by a spring (not shown in the drawings), press-pushes the belt so as to form a curved paper sheet path in the section between the belt unit 707B and the pressure roller 707C. The paper sheet P passes through the curved paper sheet path formed by the pressure roller 707C, so that the convex curl of the paper sheet P is rectified by applying a bending force, the direction of which is opposite to the convex curl, to the paper sheet P.

When rectifying the concave curl, a switching gate 706A, disposed at an inlet portion of the curl rectifying mechanism 706, is set at a position indicated by the dotted line, while a switching gate 707A, disposed at an inlet portion of the curl rectifying mechanism 707, is set at a position indicated by the solid line. Accordingly, the paper sheet P passes through the curl rectifying mechanism 706, and bypasses the curl rectifying mechanism 707 without passing through it.

When rectifying the convex curl, the switching gate 706A, disposed at the inlet portion of the curl rectifying mechanism 706, is set at a position indicated by the solid line, while the switching gate 707A, disposed at the inlet portion of the curl rectifying mechanism 707, is set at a position indicated by the dotted line. Accordingly, the paper sheet P bypasses the curl rectifying mechanism 706 without passing through it, and passes through the curl rectifying mechanism 707.

When the paper sheet P is simply conveyed in the relay conveyance unit C without applying the curl rectifying operation, both the switching gates 706A and 707A are set at positions indicated by the solid lines, respectively, so that the paper sheet P bypasses both of them.

Any one of the "concave curl rectifying mode", the "convex curl rectifying mode" and the "without curl rectifying mode" can be selected in response to the setting contents inputted by the operator from an operating section (not shown in the drawings) of the color image forming apparatus A or transmitted from an external device, such as a personal computer, etc.

The paper sheet P ejected from the color image forming apparatus A is conveyed by a conveyance roller R1 so as to run upward through a conveyance path H1 formed by a guide plate 718A, a guide plate 729 and a guide plate 718B, and further, conveyed by a pair of conveyance rollers R2 so as to run upward through a conveyance path H2 formed by a pair of guide plates 719A, 719B. Successively, the paper sheet P passes through the position of the curl rectifying mechanism 706.

The paper sheet P, passing through the position of the curl rectifying mechanism 706, is further conveyed by a pair of conveyance rollers R4 so as to run downward through a conveyance path H3 formed by a pair of guide plates 723A, 723B, and still further, conveyed by a pair of conveyance rollers R5 and a pair of conveyance rollers R6 so that the paper sheet P is ejected from the relay conveyance unit C and conveyed into the post processing apparatus B.

Next, referring to FIG. 1, the post processing apparatus B will be detailed in the following.

A paper sheet inlet BA (shown in FIG. 2) of a post processing apparatus carry-in section 10 opposes to a paper sheet outlet CB of the relay conveyance unit C.

The paper sheet P, conveyed by a pair of rollers 211 at the paper sheet inlet BA, is branched to any one of a post processing apparatus ejecting section 220, a punch processing section 40 and a fold processing section 60 by a conveyance path switching section G1.

When the punch processing and the fold processing are not applied, the conveyance path switching section G1 closes a conveyance path led to the punch processing section 40, while opens another conveyance path led to the post processing apparatus ejecting section 220.

The paper sheet P, passing through a first conveyance path p1 led to the post processing apparatus ejecting section 220, is straightly conveyed in a tightly clipped state by a pair of conveyance rollers 221 and a pair of conveyance rollers 222, and ejected from the post processing apparatus ejecting section 220 by a pair of ejecting rollers 223, so as to stack the paper sheet P onto a main ejecting tray 224 capable of elevating and descending. The maximum stacking capacity of the main ejecting tray 224 is 2000 sheets of paper sheet P.

The paper sheet P, branched to the upper section located downstream in the conveyance direction of the pair of conveyance rollers 222 as shown in FIG. 1, passes through a pair of conveyance rollers 225 equipped in a sixth conveyance path p6, and ejected by a pair of ejecting rollers 226, so as to stack the paper sheet P onto a sub ejecting tray 227 (a top tray), serving as a post processing apparatus ejecting section disposed at the upper portion of the post processing apparatus B.

A cover paper sheet or insert paper sheet S accommodated in a paper sheet feeding tray 231 of a paper sheet adding section 30 is picked up and fed by the pickup rollers 232, and conveyed through a fifth conveyance path p5 in a tightly clipped state by pairs of conveyance rollers 233, 234, 235, 236, and merges into the conveyance path located upstream the branching section (confluent section).

The paper sheet feeding tray 231 of the paper sheet adding section 30 includes two stages of upper and lower trays. The maximum accommodating capacity of each of the upper and lower trays is 500 sheets of the cover paper sheet or insert paper sheet S.

Incidentally, by loading the paper sheet P onto the paper sheet adding section 30, it is also possible to apply the punch processing and/or the fold processing to the paper sheet P without forming an image on the paper sheet P.

The paper sheet P, branched by the conveyance path switching section G1, is tightly clipped and conveyed through a second conveyance path p2 to the punch processing section 40 (first processing section) by a pair of conveyance rollers 241 disposed below the conveyance path switching section G1.

A truing section 242 is disposed along the conveyance path located at downstream side of the punch processing section 40, in order to true the width direction of the paper sheet P before the punch processing.

A puncher equipped in the punch processing section 40 is constituted by a punching mechanism driven by a driving device (not shown in the drawings) and a dies fitted into an edge portion of the puncher. The paper sheet P for which the punch processing is completed is sent to a conveyance section 50 located below (punching function).

The paper sheet P conveyed into a conveyance section 50 is tightly clipped by pairs of conveyance rollers 51, 52, 53, 54, so as to further convey the paper sheet P into the fold processing section 60. Each of the pairs of conveyance rollers 51, 52, 53, 54 is constituted by a driving roller that is coupled to a driving source and a driven roller press-contacting the driving roller. A solenoid SOL is connected to the driven roller, so as to move the driven roller between a press-contacting position and a separating position onto/from the driving roller.

Among small-sized paper sheets P onto which the punch processing is already applied, a small-sized paper sheet P, to which the fold processing is not to be applied, is branched into a third-A conveyance path P3A by a conveyance path switching section G3, and is clipped and conveyed by a pair of conveyance rollers 600. A large-sized paper sheet P, onto which the punch processing is already applied, is conveyed into third-B conveyance path P3B located below the branching position of the conveyance path switching section G3, irrespective of whether or not the fold processing is required, and is further conveyed by the pairs of conveyance rollers 53, 54, so as to introduce it into the fold processing section 60. In this connection, a combination of the third-A conveyance path P3A and the third-B conveyance path P3B constitutes a third conveyance path.

Incidentally, a conveyance path switching section 55 is equipped in the conveyance section 50, in order to make it possible to apply the fold processing to two paper sheets at a time by conveying two small-sized paper sheets P in a state of overlapping them with each other.

The paper sheet P, conveyed into the fold processing section 60 from the conveyance section 50, is tightly clipped and conveyed by a pair of registration rollers 601, so that various kinds of fold processing (folding functions), such as an outward center fold processing, an inward center fold processing, a Z-shaped fold processing, an outward threefold processing, an inward fourfold processing, a double parallel fold processing, etc., can be applied to the paper sheet P in a first folding section 61, a second folding section 62 and a third folding section 63, and then, returns to the first conveyance path p1 through a fourth conveyance path p4.

As described in the foregoing, the paper sheet conveyance path equipped in the post processing apparatus B is complicated and lengthy, since it is constituted by the various conveyance paths, including the first conveyance path p1, the second conveyance path p2, the third-A conveyance path P3A, the third-B conveyance path P3B, the first folding section 61, the second folding section 62 and the third folding section 63. In the present embodiment, however, by setting the line velocity of the paper sheet running through the post processing apparatus B at a value higher than that of the paper sheet running through the color image forming apparatus A, it becomes possible to maintain a wide interval between the paper sheets, which are continuously conveyed in the post processing apparatus B. This makes it possible to smoothly conduct the paper sheet conveying operation and the post processing in such the complicated and lengthy paper sheet conveyance path equipped in the post processing apparatus B, compared to that equipped in the color image forming apparatus A.

The difference between the line velocity of the paper sheet running through the color image forming apparatus A and that of the paper sheet running through the post processing apparatus B is adjusted in the relay conveyance unit C, as will be detailed in the following.

The line velocity of the paper sheet P conveyed in the relay conveyance unit C is equal to that of the paper sheet P conveyed in the color image forming apparatus A, until the trailing edge of the paper sheet P has passed through a paper sheet sensor S1 disposed at the paper sheet introducing section of the relay conveyance unit C. Then, after the trailing edge of the paper sheet P passes through a paper sheet sensor S1, the paper sheet P is conveyed at a changed line velocity equal to that of the paper sheet P to be conveyed in the post processing apparatus B.

Next, referring to FIG. 2 through FIG. 5, connecting structures between the color image forming apparatus A, the relay conveyance unit C and the post processing apparatus B will be detailed in the following.

Figure 3:
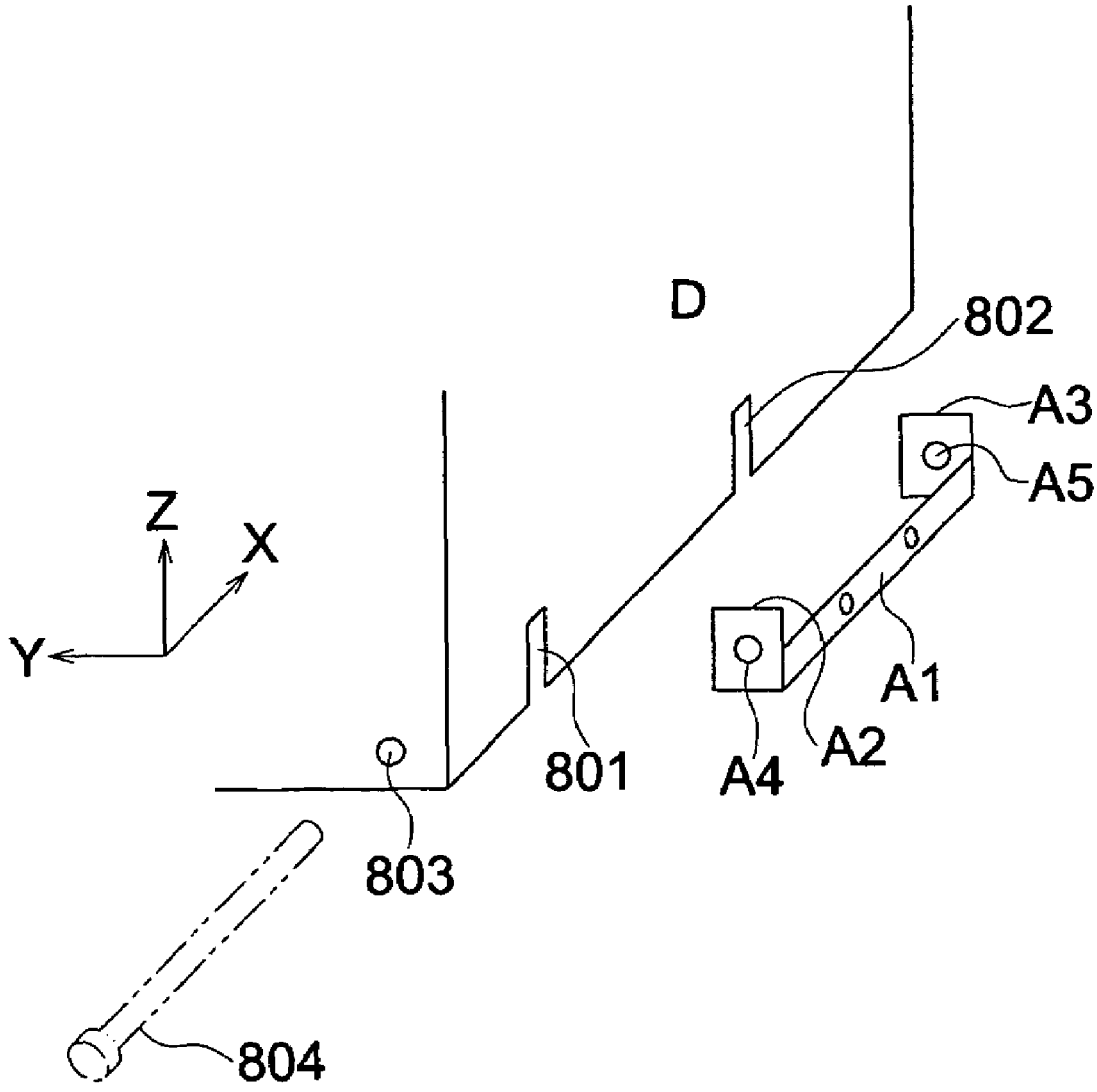
FIG. 3 shows a structure for connecting a color image forming apparatus with an electric power source unit.
Figure 4:
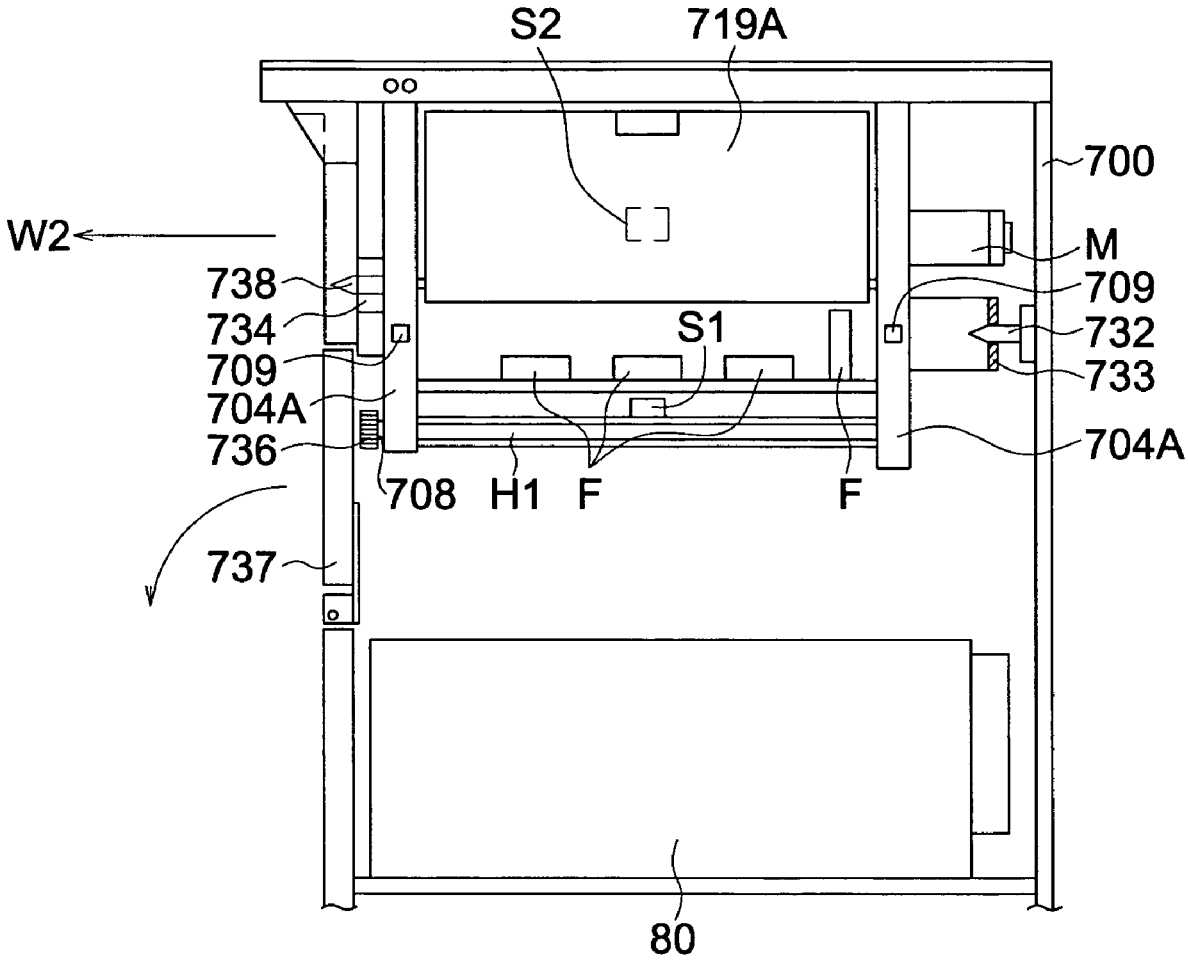
FIG. 4 shows a side view of the relay conveyance unit shown in FIG. 1, when viewing it from a side of a color image forming apparatus.
Figure 5:
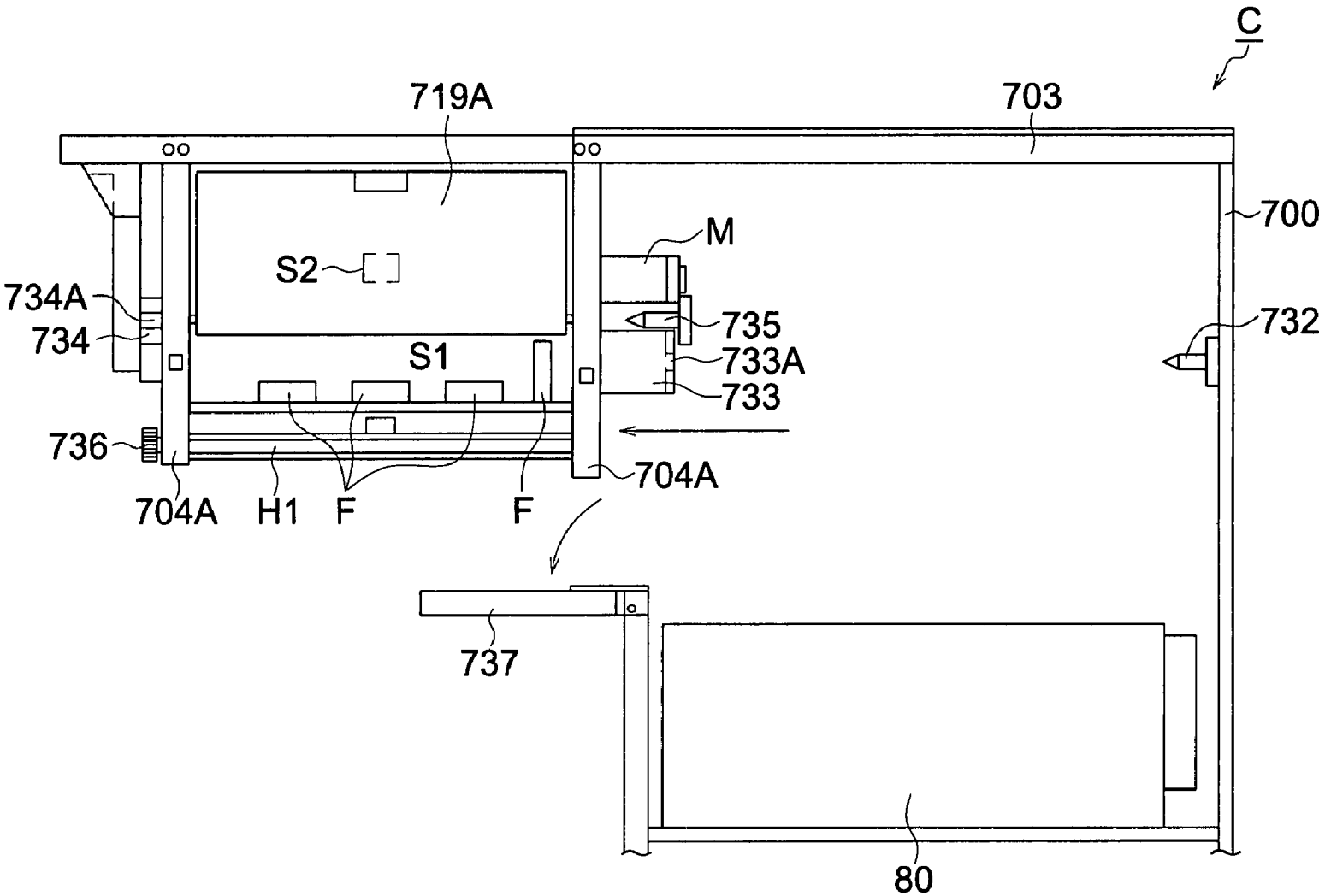
FIG. 5 shows a side view of the relay conveyance unit shown in FIG. 1, when viewing it from a side of a color image forming apparatus.

FIG. 3 shows a structure for connecting the color image forming apparatus A with an electric power source unit D. FIGS. 4 and 5 show side views of the relay conveyance unit C, when viewing it from a side of the color image forming apparatus A, namely, FIG. 4 shows a state that the relay conveyance unit C is mounted at an operating position, while FIG. 5 shows a state that the relay conveyance unit C is drawn from a casing.

The color image forming apparatus A and the post processing apparatus B are coupled to each other by the electric power source unit D, serving as the coupling device disposed at a lower section of the relay conveyance unit C. Incidentally, the electric power source unit D incorporates a power source for supplying electric power to motors, etc. provided in the relay conveyance unit C.

In FIG. 3, numeral A1 indicates a coupling plate to be fixed at the side surface of the color image forming apparatus A, which opposes to the electric power source unit D. The coupling plate A1 is provided with elect sections A2, A3. Further, the elect sections A2, A3 are provided with coupling holes A4, A5 serving as fixing features, respectively.

On the other hand, coupling notches 801, 802, serving as fixing features into which the elect sections A2, A3 can be inserted, are formed on the side surface of the electric power source unit D, which opposes to the color image forming apparatus A. Further, a coupling hole 803, serving as a fixing feature, is provided on the front surface of the electric power source unit D so as to insert a bar 804, serving as a fixing feature, into the coupling hole 803.

By making the color image forming apparatus A and the electric power source unit D approach each other, the elect sections A2, A3 are fitted into the coupling notches 801, 802. Accordingly, a position of the electric power source unit D in an X-axis direction (a front to rear direction) is fixed with respect to that of the color image forming apparatus A.

Next, the bar 804 is inserted into the coupling hole 803 and the coupling holes A4, A5. Accordingly, a position of the electric power source unit D in both a Y-axis direction (a left to right direction) and a Z-axis direction (a upper to lower direction) is fixed with respect to that of the color image forming apparatus A.

According to the fixing procedure mentioned in the above, the electric power source unit D is fixed to the color image forming apparatus A in respect to the front to rear, the left to right and the upper to lower directions.

Further, referring to the FIG. 1, the connection between the post processing apparatus B and the electric power source unit D will be detailed in the following.

A coupling plate 805 is fixed onto the side surface of the electric power source unit D, which opposes to the post processing apparatus B, in such a manner that the coupling plate 805 is protruded therefrom. By fixing the coupling plate 805 onto the main frame of the post processing apparatus B by employing screws 806, the post processing apparatus B and the electric power source unit D are coupled and fixed to each other.

As mentioned in the above, since the color image forming apparatus A and the post processing apparatus B are coupled to each other while putting the electric power source unit D between them, an intermediate space, for which the positional relationship between them is fixed, is formed, so that the relay conveyance unit C can be inserted and installed in the intermediate space.

A supporting frame 700 is fixed onto the side surface of the color image forming apparatus A, which opposes to the relay conveyance unit C, by employing screws 713, 714, while a supporting frame 701 is fixed onto the side surface of the post processing apparatus B, which opposes to the relay conveyance unit C, by employing screws 711, 712.

The relay conveyance unit C is constituted by various kinds of parts disposed within a space located between a supporting plate 704A, which opposes to the color image forming apparatus A, and a supporting plate 704B, which opposes to the post processing apparatus B. Further, a protruded portion 709, fixed onto the lower section of the supporting plate 704A and serving as a positioning element, and a protruded portion 710, fixed onto the lower section of the supporting plate 704B and serving as a positioning element, are respectively placed on elect sections 716, 715, formed at both lower end portions of the supporting frames 700, 701 and serving as positioning elements, so that the height of the relay conveyance unit C is set at such a value that the height relationships of the relay conveyance unit C versus both the color image forming apparatus A and the post processing apparatus B can be kept constant. Accordingly, the heights of the paper sheet outlet AB of the color image forming apparatus A and a paper sheet inlet CA of the relay conveyance unit C match with each other, and the heights of the paper sheet outlet CB of the relay conveyance unit C and the paper sheet inlet BA of the post processing apparatus B match with each other. As mentioned in the above, the height of the relay conveyance unit C versus those of the color image forming apparatus A and the post processing apparatus B is established.

The relay conveyance unit C can be drawn from the image forming system. FIG. 4 shows a state that the relay conveyance unit C is mounted at the operating position, while FIG. 5 shows a state that the relay conveyance unit C is drawn from the casing. The relay conveyance unit C is detachably guided on a pair of sliding rails 702, 703 shown in FIG. 4 and FIG. 5, so as to mount or dismount the relay conveyance unit C into/from the image forming system.

When mounting the relay conveyance unit C, in order to accurately position the relay conveyance unit C in the image forming system, the supporting frame 700 is provided with positioning pins 732, 735, so that the positioning pin 732 is fitted into a positioning hole 733A formed on a fixing member 733 fixed onto the relay conveyance unit C, while the positioning pin 735 is fitted into a positioning hole 734A formed on a fixing member 734 fixed onto the relay conveyance unit C. Incidentally, as shown in FIG. 4 and FIG. 5, the supporting frame 700 is extended up to the rear surface of the relay conveyance unit C.

When the paper sheet P jams in the relay conveyance unit C, the relay conveyance unit C is drawn from the system in the direction indicated by the arrow W2 shown in FIG. 4, while guided on the pair of sliding rails 702, 703, and stopped at a position shown in FIG. 5.

In order to remove the paper sheet P jamming in the relay conveyance unit C, the guide plate is moved to the position indicated by the chain dash lines shown in FIG. 2, so as to open the conveyance path.

Concretely speaking, the paper sheet P jamming at the paper sheet inlet portion can be removed by rotating the guide plate 729 around a shaft 730, serving as a center of the rotation, in a clockwise direction as indicated by the chain dash lines shown in FIG. 2. Incidentally, since the guide plate 729 is urged towards counterclockwise direction by a spring 731, the guide plate 729 automatically retunes to the operating position indicated by the solid lines shown in FIG. 2, when the operator releases his hand from the guide plate 729.

Further, the paper sheet P jamming at the upstream side of the curl rectifying mechanism 706 can be removed by rotating a guide plate 719A in a clockwise direction as indicated by the chain dash lines shown in FIG. 2. Incidentally, since the guide plate 719A is urged towards counterclockwise direction by a spring 720, the guide plate 719A automatically retunes to the operating position indicated by the solid lines shown in FIG. 2, when the operator releases his hand from the guide plate 719A. Still further, the paper sheet P jamming at the intermediate section between the curl rectifying mechanism 706 and the curl rectifying mechanism 707 can be removed by rotating a guide plate 723A in a counterclockwise direction to the position indicated by the chain dash lines shown in FIG. 2.

Since the guide plate 723A is urged towards clockwise direction by a spring 724, the guide plate 723A automatically retunes to the operating position indicated by the solid lines shown in FIG. 2, when the operator releases his hand from the guide plate 723A.

Further, the paper sheet P jamming at the paper sheet ejecting section of the relay conveyance unit C can be ejected from the paper sheet outlet CB by rotating a rotor grip 736, namely, rotating the pair of conveyance rollers R6 coupled to the rotor grip 736.

Numeral 737 indicates a front panel to cover a space located between the lower section of the relay conveyance unit C and the electric power source unit D. When drawing the relay conveyance unit C, the front panel 737 is opened by rotating it from the closed position shown in FIG. 4 to the opened position shown in FIG. 5, while, when the relay conveyance unit C is mounted, the front panel 737 is closed by covering the space as shown in FIG. 4, and locked by the stopper element (not shown in the drawings), such as a magnet, etc. In FIG. 4 and FIG. 5, symbol M indicates a motor for driving the paper sheet conveyance rollers equipped in the relay conveyance unit C, symbol F indicates four fans for cooling the paper sheet P and symbol S2 indicates a paper sheet sensor for detecting a paper sheet jamming.

In the embodiment shown in the drawings, the relay conveyance unit C and the electric power source unit D are installed in the intermediate space located between the color image forming apparatus A and the post processing apparatus B. However, the present invention can be also applied to such an image forming system in which, for instance, a plurality of paper sheet processing apparatuses are coupled to the image forming apparatus and a relay conveyance apparatus is inserted between the paper sheet processing apparatuses.

Further, in the embodiment shown in the drawings, the relay conveyance unit C is provided with the curl rectifying mechanisms. Other than the abovementioned function, however, it is also applicable that the relay conveyance unit C may be provided with various kinds of functions, such as a function for adjusting the difference between the conveyance velocity in the color image forming apparatus A and that in the post processing apparatus B, a post processing functions including a fold processing, a punch processing, etc., a paper sheet adding function for adding an additional paper sheet to the paper sheets, on which images are already formed in the color image forming apparatus A, as an indicator sheet or a dividing sheet, etc.

Still further, it is also applicable that the connecting section is constituted by a connecting arm or a connecting plate without having a functional section, such as a power source, etc., as indicated in the embodiment shown in the drawings.

According to the present invention, since the relay conveyance apparatus is divided into the relay conveyance unit and the coupling unit, so as to couple the paper-sheet processing apparatuses, to be disposed at both sides of the relay conveyance apparatus, to each other by putting the coupling unit between them, and since the positional relationship between the paper-sheet processing apparatuses are fixed, it becomes possible to easily install the image forming system without consuming man hour, even if the width of the relay conveyance apparatus is narrowed.

While the preferred embodiments of the present invention have been described using specific term, such description is for illustrative purpose only, and it is to be understood that changes and variations may be made without departing from the spirit and scope of the appended claims.

What is claimed is:

1. An image forming system, comprising:

a plurality of paper sheet processing apparatuses including an image forming apparatus that forms an image on a paper sheet; and a relay conveyance apparatus that is installed between a former paper-sheet processing apparatus and a latter paper-sheet processing apparatus, both included in the plurality of paper sheet processing apparatuses, so as to relay the paper sheet from the former paper-sheet processing apparatus to the latter paper-sheet processing apparatus;

wherein the relay conveyance apparatus includes:

a relay conveyance unit, disposed at an upper space of the relay conveyance apparatus and provided with a paper sheet inlet and a paper sheet outlet, to convey the paper sheet introduced from the paper sheet inlet therein and eject the paper sheet outside from the paper sheet outlet; and a coupling unit that is structured as an independent body being separate from the relay conveyance unit and installed just below the relay conveyance unit so as to create an intermediate space into which the relay conveyance unit can be mounted;

wherein the coupling unit is provided with fixing members for securely fixing the former paper-sheet processing apparatus and the latter paper-sheet processing apparatus to the relay conveyance apparatus, in such a manner that the paper sheet inlet and the paper sheet outlet substantially coincide with a paper sheet outlet of the former paper-sheet processing apparatus and a paper sheet inlet of the latter paper-sheet processing apparatus, respectively.

2. The image forming system of claim 1, wherein both the former paper-sheet processing apparatus and the latter paper-sheet processing apparatus are provided with a positioning member for adjusting a height of the relay conveyance unit.

3. The image forming system of claim 1, wherein the coupling unit couples the image forming apparatus as one of the plurality of paper sheet processing apparatuses to a post processing apparatus as one of the plurality of paper sheet processing apparatuses.

4. The image forming system of claim 1, wherein the fixing members fix the former paper-sheet processing apparatus and the latter paper-sheet processing apparatus to the relay conveyance apparatus in both a right-to-left direction and an upper-to-lower direction.

5. The image forming system of claim 1, wherein the plurality of paper sheet processing apparatuses includes a post processing apparatus that applies a post processing to the paper sheet introduced therein; and wherein the coupling unit couples a plurality of post processing apparatuses to each other.

6. The image forming system of claim 1, wherein the coupling unit is further provided with an electric power supply for supplying electric power to the relay conveyance unit.

7. The image forming system of claim 1, wherein the relay conveyance unit is provided with a paper sheet processing section.

8. The image forming system of claim 1, wherein the relay conveyance unit adjusts a difference between a conveyance velocity of the paper sheet conveyed in the former paper-sheet processing apparatus and that of the paper sheet conveyed in the latter paper-sheet processing apparatus.

9. A relay conveyance apparatus that is installed in an intermediate space formed between any pair of a former paper-sheet processing apparatus and a latter paper-sheet processing apparatus, both included in a plurality of paper sheet processing apparatuses, the relay conveyance apparatus comprising:

a coupling unit to fix the former paper-sheet processing apparatus and the latter paper-sheet processing apparatus to the relay conveyance unit in a predetermined positional relationship between them, so as to form the intermediate space; and a relay conveyance unit to be mounted in the intermediate space and provided with a paper sheet conveying member which conveys the paper sheet from the former paper sheet processing apparatus to the latter paper sheet processing apparatus;

wherein the coupling unit is structured as an independent body being separate from the relay conveyance unit and installed just below the relay conveyance unit so as to create the intermediate space into which the relay conveyance unit can be mounted.

10. The relay conveyance apparatus of claim 9, wherein the relay conveyance unit is provided with a paper sheet processing section.

11. The relay conveyance apparatus of claim 9, wherein the coupling unit is further provided with an electric power supply for supplying electric power to the relay conveyance unit.

12. The relay conveyance apparatus of claim 9, wherein the relay conveyance unit adjusts a difference between a conveyance velocity of the paper sheet conveyed in the former paper-sheet processing apparatus and that of the paper sheet conveyed in the latter paper-sheet processing apparatus.

13. A method for installing a plurality of paper-sheet processing apparatuses including an image forming apparatus in an image forming system, comprising:

connecting two paper-sheet processing apparatuses to each other by employing a coupling apparatus to be installed between the two paper-sheet processing apparatuses;

fixing a positional relationship of a former paper-sheet processing apparatus and a latter paper-sheet processing apparatus in a upper-to-lower direction, a right-to-left direction and a front-to-rear direction;

installing a relay conveyance unit in an intermediate space formed between the former paper-sheet processing apparatus and the latter paper-sheet processing apparatus; and adjusting positions of paper sheet inlets and outlets, which are provided in the former paper-sheet processing apparatus and the latter paper-sheet processing apparatus, to those of the relay conveyance unit, so that a paper sheet outlet of the former paper-sheet processing apparatus and a paper sheet outlet of the relay conveyance unit substantially coincide with a paper sheet inlet of the relay conveyance and a paper sheet inlet of the latter paper-sheet processing apparatus, respectively;

wherein the coupling unit is structured as an independent body being separate from the relay conveyance unit and installed just below the relay conveyance unit so as to create the intermediate space into which the relay conveyance unit can be mounted.

14. The method of claim 13, wherein the former paper-sheet processing apparatus and the latter paper-sheet processing apparatus are coupled to each other by a lower section of the coupling apparatus, while the relay conveyance unit is installed in an upper space of the coupling apparatus, so as to convey a paper sheet from the former paper-sheet processing apparatus to the latter paper-sheet processing apparatus.

* * * * *